US008186671B2

(12) United States Patent
Nishiyama

(10) Patent No.: US 8,186,671 B2
(45) Date of Patent: May 29, 2012

(54) SHEET FEEDING DEVICE AND IMAGE FORMING APPARATUS WITH REAR END RESTRICTION MEMBERS

(75) Inventor: Tatsuo Nishiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/563,376

(22) Filed: Sep. 21, 2009

(65) Prior Publication Data

US 2010/0078875 A1 Apr. 1, 2010

(30) Foreign Application Priority Data

Oct. 1, 2008 (JP) ..... 2008-256335

(51) Int. Cl.
*B65H 1/00* (2006.01)

(52) U.S. Cl. ..... 271/171; 271/167

(58) Field of Classification Search ..... 271/167, 271/171

See application file for complete search history.

(56) References Cited

U.S. PATENT DOCUMENTS

| | | | | |
|---|---|---|---|---|
| 5,199,695 | A * | 4/1993 | Nakahata et al. | 271/171 |
| 5,632,477 | A * | 5/1997 | Morinaga | 271/171 |
| 5,815,787 | A * | 9/1998 | Crayton et al. | 271/171 |
| 7,862,036 | B2 * | 1/2011 | Rowe et al. | 271/171 |

FOREIGN PATENT DOCUMENTS

| | | | |
|---|---|---|---|
| JP | 10-77123 | | 3/1998 |
| JP | 10-077123 | A | 3/1998 |
| JP | 10077123 | A * | 3/1998 |

OTHER PUBLICATIONS

Office Action issued in Chinese Patent Office Application No. 200910177483.1, dated Jul. 11, 2011.

* cited by examiner

*Primary Examiner* — Gerald McClain

(74) *Attorney, Agent, or Firm* — Fitzpatrick, Cella, Harper & Scinto

(57) ABSTRACT

A sheet cassette includes a cassette main body, an intermediate plate, a pressure spring, and a first rear end restriction member provided slidably along a sheet feeding direction and restricting a rear end of a sheet. The sheet cassette also includes a second rear end restriction member provided slidably in the first rear end restriction member along the sheet feeding direction and restricting the rear end of the sheet. The first rear end restriction member includes a first height restriction portion restricting a height of a sheet of a predetermined size loaded in the cassette main body to a first height. The second rear end restriction member includes a second height restriction portion restricting a height of a sheet of a size smaller than the predetermined size loaded in the cassette main body to a second height smaller than the first height.

16 Claims, 12 Drawing Sheets

SHEET FEEDING DEVICE AND IMAGE FORMING APPARATUS WITH REAR END RESTRICTION MEMBERS

This application claims the benefit of Japanese Patent Application No. 2008-256335, filed Oct. 1, 2008, which is hereby incorporated by reference herein in its entirety.

BACKGROUND OF THE INVENTION

1. Field of the Invention

The present invention relates to a sheet feeding device including a sheet cassette on which sheets of various sizes can be loaded, and an image forming apparatus such as a copying machine including a sheet feeding device, a printer, a multifunctional machine including a copying function and a printer function or a fax machine.

2. Description of the Related Art

Recently, image forming apparatuses such as a copying machine, a printer, a multifunctional machine that includes a copying function and a printer function and a fax machine are widely used. A sheet cassette of the image forming apparatus of this type normally includes an intermediate plate provided in a cassette main body and pressure springs (helical compression springs) that serve as biasing members arranged between the cassette main body and the intermediate plate. The sheet cassette is configured so that each of the pressure springs applies a biasing force to the intermediate plate, thereby pressure-contacting a tip end of each of sheets loaded on the intermediate plate with a sheet feeding roller and separately feeding the sheets starting at an uppermost sheet loaded on the sheet cassette one by one.

Generally, if a height of the sheets loaded on the intermediate plate is large, a compression amount of each pressure spring is large. Conversely, if the height of the loaded sheets is small, the compression amount of each pressure spring is small. In other words, as the height of the sheets loaded in the sheet cassette is larger, pressure acting on the sheet feeding roller (sheet feeding pressure) when the intermediate plate presses a sheet against the sheet feeding roller increases.

To stably feed sheets, this sheet feeding pressure should fall in a constant range irrespectively of the height of the loaded sheets. To meet this demand, according to a conventional technique, a spring constant of each pressure spring is set appropriately, thereby keeping the sheet feeding pressure in the constant range irrespectively of the compression amount of each pressure spring (that is, the height of the loaded sheets).

However, a change in a gross weight of sheets due to a difference in size among the sheets loaded on the intermediate plate cannot be often dealt with appropriately only by setting of the spring constant. For example, if sheets equal to or larger in size than an A4 sheet or an A5 sheet such as a letter-size sheet (referred to as "large-size sheet", hereinafter) and sheets equal to or smaller in size than a large-size sheet such as an A6 sheet (referred to as "small-size sheet", hereinafter) are loaded by the same number, the small-size sheets are lighter in weight than the large-size sheets. Due to this, if the spring constant of each pressure spring is set to be fit to the large-size sheets, then the sheet feeding pressure is too high for the small-size sheets and multiple-feeding tends to occur. Conversely, if the spring constant of each pressure spring is set to be fit to the small-size sheets, then the sheet feeding pressure is too low for the large-size sheets because of the heavier weight of the large-size sheets than that of the small-size sheets, and non-feeding tends to occur. Further, a larger-capacity sheet cassette in which a large quantity of sheets can be loaded tends to have a fluctuation in the sheet feeding pressure.

Considering the problems, there is proposed a sheet cassette that includes rear end guides that can be detachably attached to an intermediate plate, that have different restricted heights according to sheet sizes and that restrict the number of sheets loaded on the intermediate plate as disclosed in Japanese Patent Application Laid-Open (JP-A) No. 10-77123. One of the rear end guides fit to one of a plurality of positioning holes is attached to the intermediate plate while the remaining or unused rear end guides are attached to holding holes, respectively. In this sheet cassette, the rear end guides are detached or attached for every sheet size and the height of the loaded sheets can be restricted so that the sheet feeding pressure acting on the sheet feeding roller falls within a constant range. Therefore, this sheet cassette can prevent sheet feeding failures such as multiple-feeding and non-feeding of sheets.

However, the conventional sheet cassette disclosed in the Japanese Patent Application Laid-Open No. 10-77123 has the following problems. It is necessary to detach or attach the rear end guides and to replace one rear end guide with the rear end guide fit to the sheet size whenever the sheet size is changed. Due to this, the conventional sheet cassette has poor operability. Furthermore, if a user forgets storing the rear end guides detached and unused in a preset storage area, the rear end guides are possibly lost or damaged. Moreover, when the sheet size is changed, the rear end guides are attached to or detached from the corresponding positioning holes provided in the intermediate plate, respectively. Due to this, it is disadvantageously impossible to load sheets of a size that does not correspond to any of the positioning holes provided in the intermediate plate.

The present invention, therefore, provides a sheet feeding device and an image forming apparatus that can restrict rear ends of sheets according to various sheet sizes in a stepless fashion while preventing sheet feeding failures such as multiple-feeding and non-feeding of sheets, and that can improve usability.

SUMMARY OF THE INVENTION

The present invention provides a sheet feeding device including: a sheet cassette in which a sheet is loaded; and a sheet feeding roller feeding the sheet loaded in the sheet cassette, wherein the sheet cassette includes a cassette main body; a supporting plate which is provided in the cassette main body to be able to lift and lower, and which supports the sheet and presses a tip end of the sheet loaded in the cassette main body against the sheet feeding roller; a biasing member which biases the supporting plate toward the sheet feeding roller; a first rear end restriction member provided movably along a sheet feeding direction, and restricting a rear end of the sheet loaded in the cassette main body; and a second rear end restriction member provided movably along a sheet feeding direction, and restricting the rear end of the sheet loaded in the cassette main body, the first rear end restriction member includes a first height restriction portion restricting a height of a sheet of a predetermined size loaded in the cassette main body to a first height, and the second rear end restriction member includes a second height restriction portion restricting a height of a sheet of a size smaller than the predetermined size loaded in the cassette main body to a second height smaller than the first height.

The present invention provides an image forming apparatus including: an image forming portion forming an image on a sheet; and the sheet feeding device feeding the sheet to the image forming portion.

According to the present invention, the first height restriction portion and the second height restriction portion restrict the height of loaded sheets according to various sheet sizes, respectively. It is thereby possible to set a sheet feeding pressure acting on the sheet feeding roller to fall in a constant range fit to each of the various sheet sizes and to prevent such sheet feeding failures as multiple-feeding of sheets and non-feeding of sheets. Furthermore, by moving the first rear end restriction member and the second rear end restriction member, the first rear end restriction member and the second rear end restriction member can be set in the stepless fashion to be fit to the rear ends of sheets of various sizes, and usability can be improved.

Further features of the present invention will become apparent from the following description of exemplary embodiments (with reference to the attached drawings).

DESCRIPTION OF THE EMBODIMENTS

Exemplary embodiments of the present invention will be described hereinafter with reference to the drawings.

First Embodiment

Figure 1:
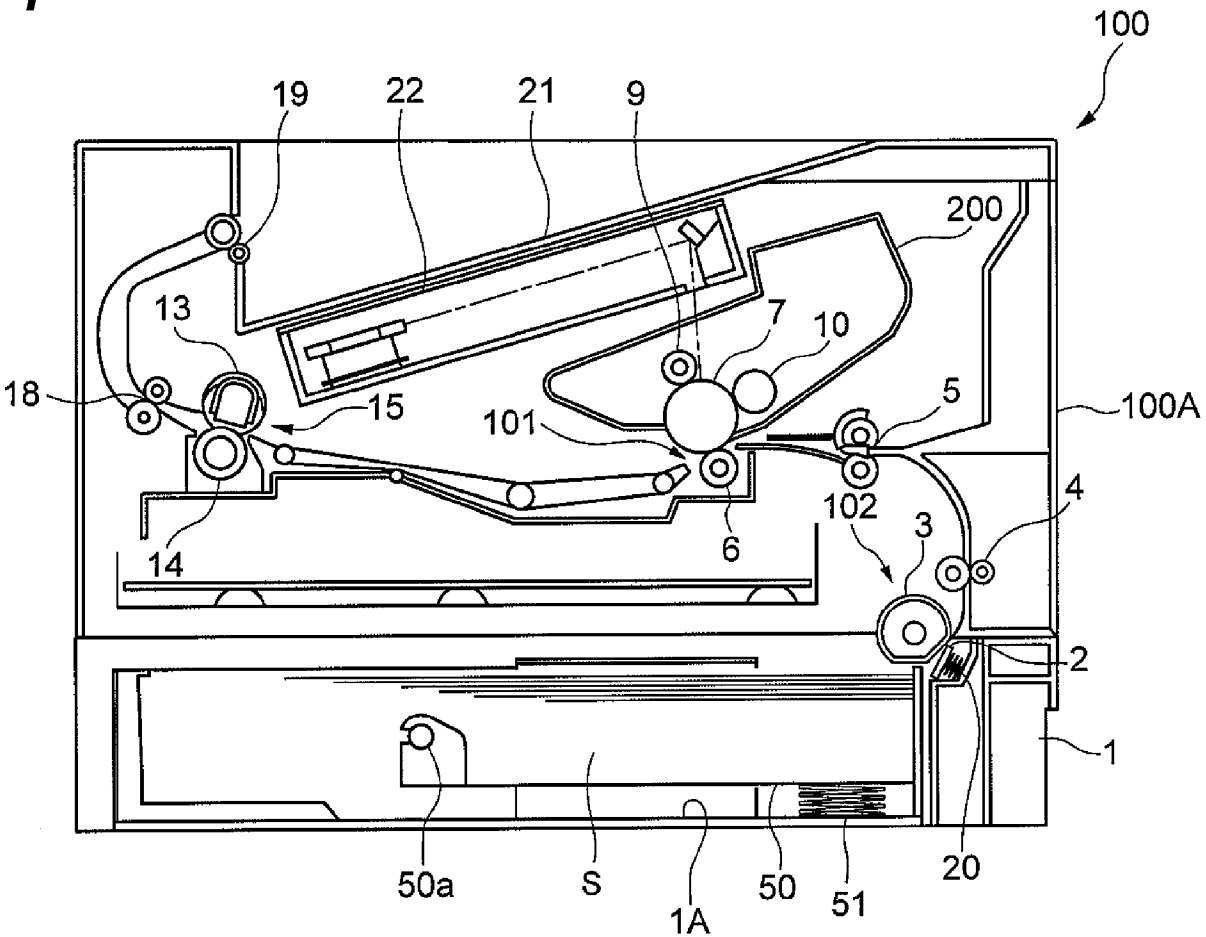
FIG. 1 is an explanatory diagram illustrating a schematic configuration of a printer as one example of an image forming apparatus according to a first embodiment of the present invention.

FIG. 1 is an explanatory diagram illustrating a schematic configuration of a printer as one example of an image forming apparatus according to a first embodiment of the present invention.

In FIG. 1, a laser printer 100 includes an image forming portion 101 forming images, a sheet feeding device 102 separately feeding sheets S to the image forming portion 101 one by one, and the like.

The image forming portion 101 includes a process cartridge 200 and a transfer roller 6 that are detachably attached to a laser beam printer main body (referred to as "printer main body", hereinafter) 100A serving as an image forming apparatus main body. The process cartridge 200 includes a photosensitive drum 7, a charging roller 9, a development device 10, a cleaner (not shown) and the like.

The sheet feeding device 102 includes a sheet cassette 1 in which the sheets S are loaded, a generally semilunar sheet feeding roller 3 apart of a circumferential surface of which is notched, and a separation pad 2 biased toward the sheet feeding roller 3 by a pressure spring 20 with a predetermined pressure and forming a nip portion between the separation pad 2 and the sheet feeding roller 3. The sheet cassette 1 is detachably attachable to the printer main body 100A.

As shown in FIG. 1, the image forming portion 101 also includes a laser scanner unit 22, a fixing device 15 and a pair of discharge rollers 18 and 19 discharging the sheets S to a discharge tray 21.

An image forming operation performed by the laser beam printer 100 configured as stated above will be described.

Tip ends of a plurality of sheets S loaded in the sheet cassette 1 are pushed up toward the sheet feeding roller 3 by a pressure applied by an intermediate plate 50 as a supporting plate.

A personal computer, not shown, transmits image information to the laser beam printer 100. A controller, not shown, performing an image forming process on this image information transmits a print signal. In response to the print signal, the sheet feeding roller 3 rotates counterclockwise only during sheet feeding, and the sheet S loaded in the sheet cassette 1 is fed to the image forming portion 101. If a plurality of sheets S enters the nip portion between the sheet feeding roller 3 and the separation pad 2, only an uppermost sheet S is fed to the image forming portion 101 by a friction force of the separation pad 2.

On the other hand, the laser scanner unit 22 irradiates the photosensitive drum 7 with a laser beam based on the image information as well as this print instruction, whereby a latent image is formed on a surface of the photosensitive drum 7. Further, the development device 10 develops this latent image, thereby forming a toner image on the photosensitive drum 7.

Thereafter, the toner image formed on the photosensitive drum 7 as stated above is transferred onto the sheet S fed to a nip portion between the photosensitive drum 7 and the transfer roller 6 by conveying rollers 4 and 5.

The sheet S onto which the toner image is transferred is fed to the fixing device 15 and introduced to a nip portion between a heating roller 13 of the fixing device 15 and a pressure roller 14 pressure-contacting with the heating roller 13. In process of passing the sheet S through the nip, the toner image transferred onto a surface of the sheet S is heated and pressurized and fixed onto the surface of the sheet S. Thereafter, the sheet S passing through the fixing device 15 is conveyed by the paired discharge rollers 18 and 19 and discharged onto a discharge tray 21.

Meanwhile, the sheet cassette 1 includes a cassette main body 1A and the intermediate plate 50 supported by the cassette main body 1A so as to be able to lift and lower with a shaft 50*a* used as a fulcrum. The sheet cassette 1 also includes pressure springs 51 arranged between the cassette main body 1A and the intermediate plate 50 and serving as biasing members each applying a force to the intermediate plate 50 against the sheet feeding roller 3. The pressure springs 51 apply biasing forces to this intermediate plate 50, thereby enabling the tip end of each of the sheets S loaded in the cassette main body 1A to be pressed against the sheet feeding roller 3 and assisting in a sheet feeding operation.

Figure 2:
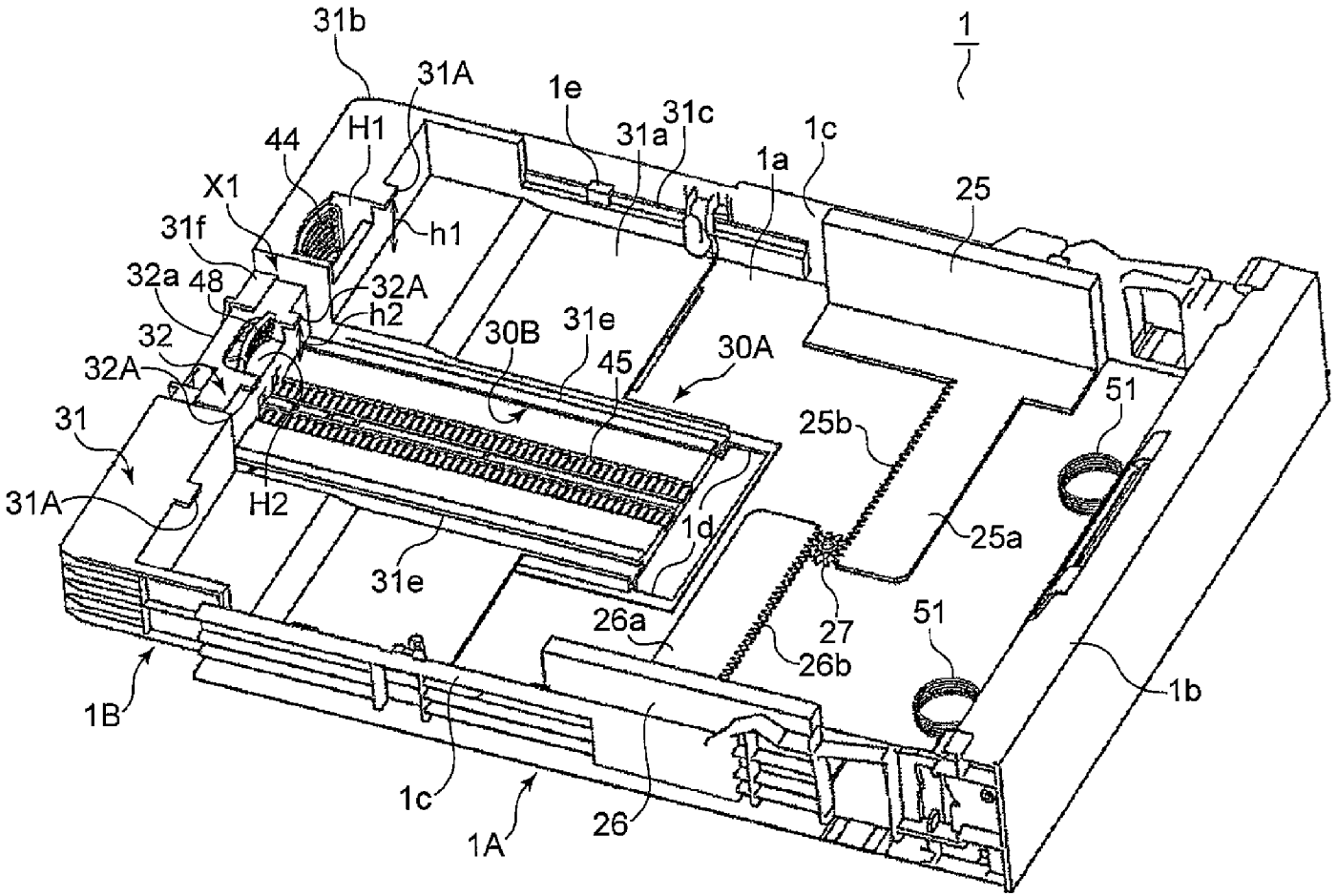
FIG. 2 is a perspective view of a sheet cassette illustrating a state in which an intermediate plate is detached according to the first embodiment.

FIG. 2 is a perspective view of the sheet cassette 1 illustrating a state in which the intermediate plate 50 is detached.

The cassette main body 1A includes a generally rectangular bottom plate 1*a*, a tip end wall 1*b* provided upright with respect to the bottom plate 1*a* and abutting on the tip end of each sheet, and sidewalls 1*c* provided upright on both sides, respectively in a width direction orthogonal to a sheet feeding direction. The cassette main body 1A has an open rear end.

The sheet cassette 1 includes a pair of side restriction plates 25 and 26 restricting side edges of the sheets S loaded on the cassette main body 1A, and a rear end restriction portion 1B provided on the rear end of the cassette main body 1A and restricting the rear ends of the sheets S loaded on the intermediate plate 50.

The side restriction plates 25 and 26 include arms 25*a* and 26*a* extending in the width direction orthogonal to the sheet feeding direction, respectively. Racks 25*b* and 26*b* engaged with a pinion 27 are formed on the arms 25*a* and 26*a*, respectively. The pinion 27 is rotatably supported on the bottom plate 1*a* of the cassette main body 1A. The arms 25*a* and 26*a*, the racks 25*b* and 26*b* and the pinion 27 constitute a moving portion a position of which can be changed according to the sheets S of each size loaded on the intermediate plate 50. This moving portion can move the side restriction plates 25 and 26 in the width direction orthogonal to the sheet feeding direction. That is, if one of the side restriction plates 25 and 26 is moved, the other plate is moved in cooperation with one plate.

The rear end restriction portion 1B includes a first rear end restriction member 31 that restricts a rear end of each sheet of a predetermined size (referred to as "large-size sheet", hereinafter) such as an A4 sheet or a letter-size sheet larger than an A5 sheet. The first rear end restriction member 31 is provided on the cassette main body 1A movably in the sheet feeding direction. The rear end restriction portion 1B also includes a second rear end restriction member 32 that restricts a rear end of each sheet of a predetermined size (referred to as "small-size sheet", hereinafter) such as an A6 sheet equal to or smaller than the A5 sheet. The second rear end restriction member 32 is provided on the first rear end restriction member 31 movably in the sheet feeding direction. That is, the second rear end restriction member 32 is for restricting the rear end of the sheet of the size smaller than that of the sheet restricted by the first rear end restriction member 31 when the small-size sheet is loaded in the cassette main body 1A.

The first rear end restriction member 31 includes a bottom plate 31*a* formed to extend toward the cassette main body 1A and supporting the rear end of each sheet and a first wall 31*b* provided upright on the bottom plate 31*a* for abutting on the rear end of the sheet. The first wall 31*b* has a notch X1 formed almost at the center of the first wall 31*b* in the width direction. Further, the first rear end restriction member 31 includes arms 31*c* formed on both sides of the first rear end restriction member 31, in the width direction orthogonal to the sheet feeding direction.

The second rear end restriction member 32 includes a second wall 32*a* located on the bottom plate 31*a* and arranged almost in a central portion of the bottom plate 31*a* in the width direction to be slidable in the sheet feeding direction for abutting on the rear end of the sheet. This second wall 32*a* of the second rear end restriction member 32 is arranged at a position corresponding to the notch X1 of the first wall 31*b* (so as not to overlap with the first wall 32*b*). Even if the second wall 32*a* slides, the second wall 32*a* is designed not to contact the first wall 31*b*. By so configuring, the second rear end restriction member 32 is out of contact with the first wall 31*b* even if the second rear end restriction member 32 is retracted upstream of the first wall 31*b* in the sheet feeding direction. A stopper 31*f* preventing detachment of the second rear end restriction member 32 is provided in the notch X1.

In this first embodiment, the sheet cassette 1 includes a first slide mechanism 30A that slides the first rear end restriction member 31 relatively to the cassette main body 1A along the sheet feeding direction. The sheet cassette 1 also includes a second slide mechanism 30B that slides the second rear end restriction member 32 relatively to the first rear end restriction member 31 along the sheet feeding direction.

Figure 3:
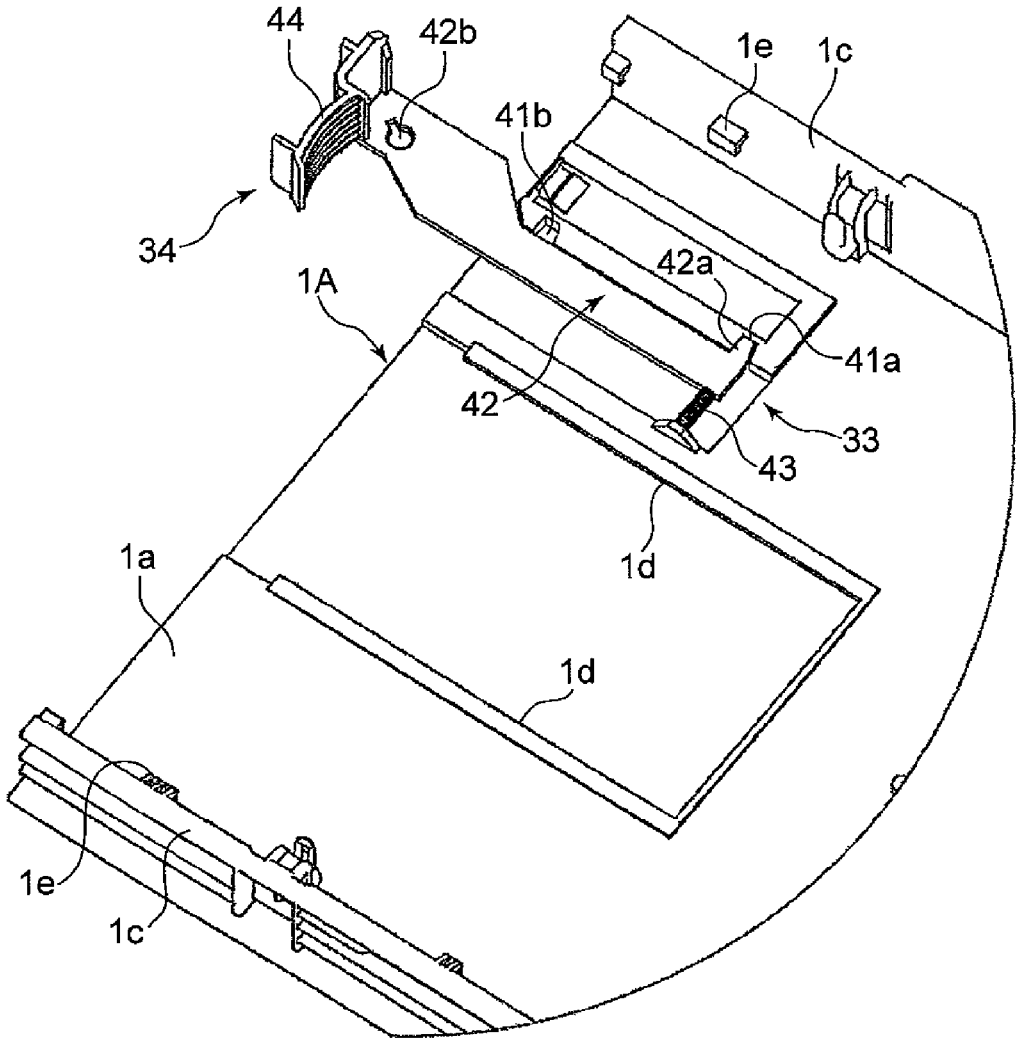
FIG. 3 is a perspective view illustrating a front surface of a cassette main body according to the first embodiment.
Figure 4:
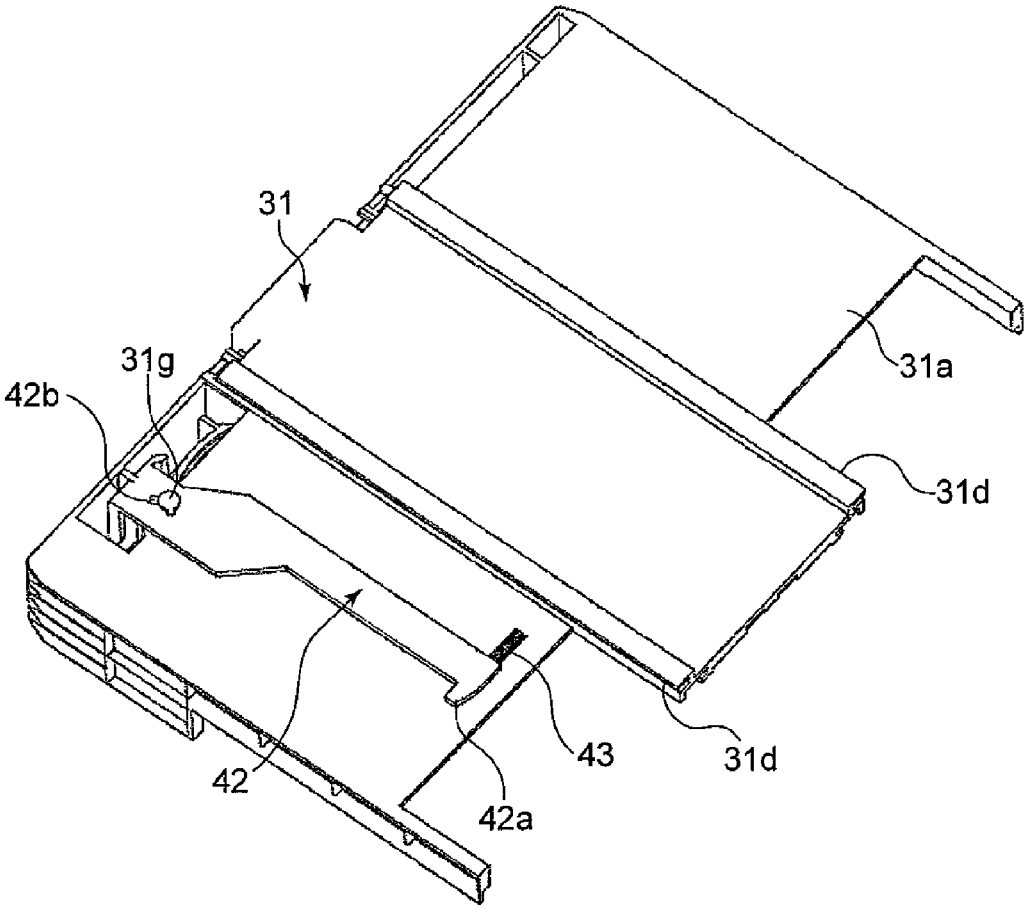
FIG. 4 is a perspective view illustrating a rear surface of a first rear end restriction member according to the first embodiment.

FIG. 3 is a perspective view illustrating a front surface of the cassette main body 1A and FIG. 4 is a perspective view illustrating a rear surface of the first rear end restriction member 31.

As shown in FIG. 3, two guide grooves 1*d* extending in the sheet feeding direction are formed on the bottom plate 1*a* of the cassette main body 1A so as to guide the bottom plate 31*a* of the first rear end restriction member 31. Further, projections 1*e* supporting the arms 31*c* of the first rear end restriction member 31 and guiding the first rear end restriction member 31 to move in the sheet feeding direction are formed inside the sidewalls 1*c*. As shown in FIG. 4, two convex portions 31*d* extending in the sheet feeding direction and slidably fitted into the respective guide grooves 1*d* are formed on a lower surface of the bottom plate 31*a* of the first rear end restriction member 31. The first rear end restriction member 31 shown in FIG. 2 is thereby slidable on the bottom plate 1*a* relatively to the cassette main body 1A along the sheet feeding direction while being guided by the guide grooves 1*d* and the projections 1*e* provided in the cassette main body 1A. That is, the guide grooves 1*d*, the convex portions 31*d*, the projections 1*e* and the arms 31*c* constitute the first slide mechanism 30A.

As shown in FIG. 2, two guide grooves 31*e* extending from a downstream end in the sheet feeding direction to positions corresponding to the notch X1 of the first wall 31*b* are provided on the bottom plate 31*a* of the first rear end restriction member 31.

Further, convex portions, not shown, slidably fitted into the two guide grooves 31*e* arranged on the bottom plate 31*a* of the first rear end restriction member 31 are formed on the second wall 32*a* of the second rear end restriction member 32. Therefore, the second rear end restriction member 32 can slide on the bottom plate 31*a* of the first rear end restriction member 31 along the sheet feeding direction while being guided by the two guide grooves 31*e*. That is, the guide grooves 31*e* and the convex portions, not shown, constitute the second slide mechanism 30B.

The first slide mechanism 30A and the second slide mechanism 30B can move the first rear end restriction member 31 and the second rear end restriction member 32 to appropriate positions in the sheet feeding directions, respectively. Only by sliding the first rear end restriction member 31 and the second rear end restriction member 32 as stated above, the rear ends of sheets S of various sizes can be restricted.

Meanwhile, if the height of the sheets S loaded on the intermediate plate 50 shown in FIG. 1 is large, the compression amount of each pressure spring 51 is large. Conversely, if the height of the loaded sheets S is small, the compression amount of each pressure spring 51 is small. In other words, as the height of the sheets S loaded on the intermediate plate 50 is larger, the sheet feeding pressure acting on the sheet feeding roller 3 increases.

Accordingly, as shown in FIG. 2, the first rear end restriction member 31 includes first height restriction pieces 31A provided on an upper end of the first wall 31*b*, protruding toward the cassette main body 1A and serving as first height restriction portions that restrict the height of the loaded sheets S to a first height h1. That is, each first height restriction piece 31A of the first rear end restriction member 31 is provided at a height position at which the sheet feeding pressure falls in a constant range fit to the large-size sheets S.

On the other hand, the sheet feeding pressure for the small-size sheets S is desirably lower than that for the large-size sheets S since the small-size sheets S are lighter than the large-size sheets S. In other words, an appropriate value of the sheet feeding pressure for the small-size sheets S is lower than that of the sheet feeding pressure for the large-size sheets S. As the compression amount of each pressure spring 51 is smaller, the sheet feeding pressure of the sheet pressure-contacting the sheet feeding roller 3 decreases.

Therefore, according to this embodiment, the second rear end restriction member 32 includes second height restriction pieces 32A provided on an upper end of the second wall 32*a*, protruding toward the cassette main body 1A and serving as second height restriction portions that restrict the height of the loaded sheets S to a second height h2 smaller than the first height h1. That is, each second height restriction piece 32A is provided at a position lower than the first height restriction pieces 31A and at a height position at which the sheet feeding pressure falls in a constant range fit to the small-size sheets S so that the height of the small-size sheets S loaded on the intermediate plate 50 is smaller than that of the large-size sheets S loaded thereon.

Figure 5:
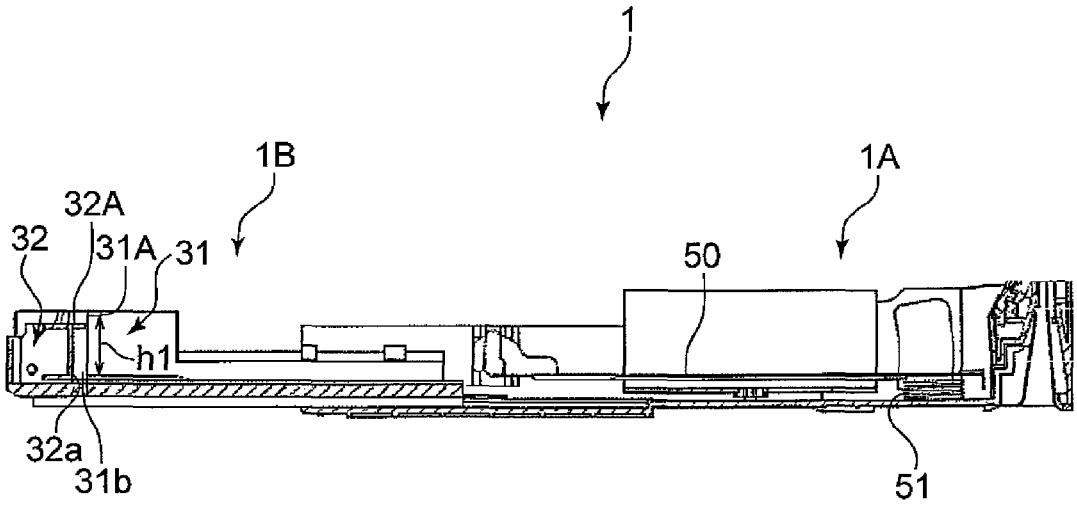
FIG. 5 is an explanatory diagram illustrating an instance of loading large-size sheets in a sheet cassette according to the first embodiment.
Figure 6:
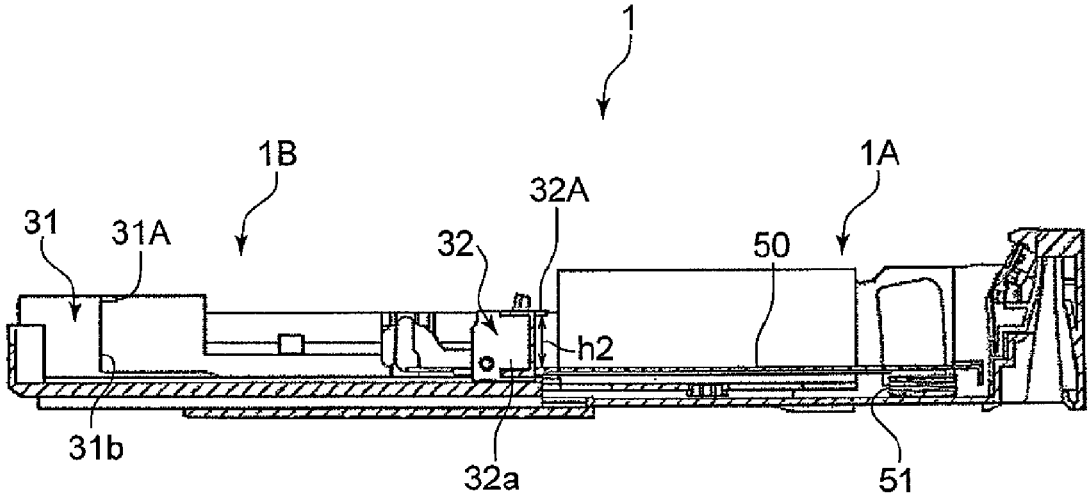
FIG. 6 is an explanatory diagram illustrating an instance of loading small-size sheets in the sheet cassette according to the first embodiment.

FIG. 5 is an explanatory diagram illustrating an instance of loading the large-size sheets S in the sheet cassette 1. FIG. 6 is an explanatory diagram illustrating an instance of loading the small-size sheets S in the sheet cassette 1.

In the first embodiment, the first rear end restriction member 31 can slide in the sheet feeding direction. Therefore, the rear end of each large-size sheet can be restricted by abutting the first wall 31*b* on the rear end of the large-size sheet. In this case, as shown in FIG. 5, if each second height restriction piece 32A of the second rear end restriction member 32 is retracted upstream of the first wall 31*b* in the sheet feeding direction, the second height restriction pieces 32A and the second wall 32*a* of the second rear end restriction member 32 do not contact the rear ends of the loaded sheets S. The first height restriction pieces 31A restrict the height of the large-size sheets S loaded on the intermediate plate 50 to the first height h1, and the sheet feeding pressure in the constant range acts on the sheet feeding roller 3 (FIG. 1).

Next, if the first rear end restriction member 31 slides downstream in the sheet feeding direction, the second rear end restriction member 32 moves along with the first rear end restriction member 31. As shown in FIG. 6, the second rear end restriction member 32 can slide further downstream in the sheet feeding direction while sliding the first rear end restriction member 31 to a downstream end in a moving range of the first rear end restriction member 31 in the sheet feeding direction. By doing so, the second wall 32*a* can abut on the rear ends of the small-size sheets S and restrict the rear ends thereof. Each second height restriction piece 32A restricts the height of the small-size sheets S loaded on the intermediate plate 50 to the second height h2, and the sheet feeding pressure in the constant range acts on the sheet feeding roller 3 (FIG. 1).

In this way, the first height restriction pieces 31A of the first rear end restriction member 31 and the second height restriction pieces 32A of the second rear end restriction member 32 can restrict the height of the loaded sheets S according to the sheets S of various sizes, that is, the large-size sheets S and the small-size sheets S, respectively. Therefore, the sheet feeding pressure acting on the sheet feeding roller 3 can be kept in the constant range fit to the sheets of each size and such sheet feeding failures as multiple-feeding of sheets and non-feeding of sheets can be prevented. Furthermore, only by sliding the first rear end restriction member 31 and the second rear end restriction member 32 without detaching or attaching the first rear end restriction member 31 and the second rear end restriction member 32, restricted positions can be set in a stepless fashion and usability can be improved.

Figure 7:
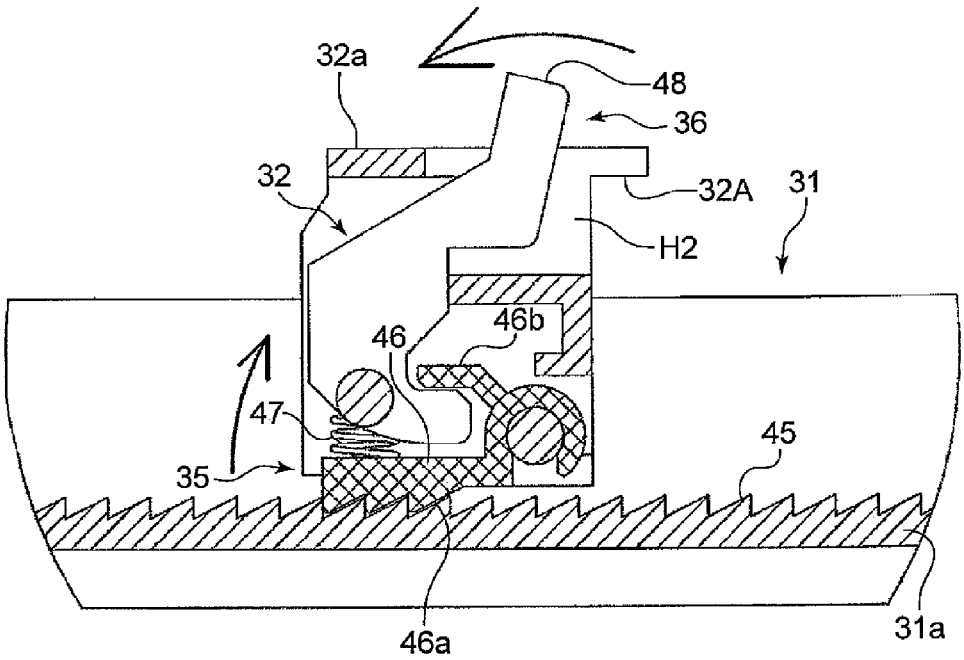
FIG. 7 is an explanatory diagram illustrating a mechanism of locking a second rear end restriction member to a first rear end restriction member according to the first embodiment.

In the first embodiment, the first rear end restriction member 31 and the second rear end restriction member 32 are configured to be able to be locked to each other so as not to move after being positioned. FIG. 7 is an explanatory diagram illustrating a mechanism of locking the second rear end restriction member 32 to the first rear end restriction member 31.

First, as shown in FIG. 3, the sheet cassette 1 includes a first locking portion 33 locking the first rear end restriction member 31 to the bottom plate la of the cassette main body 1A, and a first unlocking portion 34 that can release locking done by the first locking portion 33. As shown in FIG. 7, the sheet cassette 1 also includes a second locking portion 35 locking the second rear end restriction member 32 to the bottom plate 31*a* of the first rear end restriction member 31, and a second unlocking portion 36 that can release locking done by the second locking portion 35.

The locking mechanism will be described in detail. As shown in FIG. 3, concave portions 41*a* and 41*b* serving as a plurality of (two in FIG. 3) teeth are formed on the bottom plate 1*a* of the cassette main body 1A in the sheet feeding direction. The first locking portion 33 includes the concave portions 41*a* and 41*b*, a first locking member 42 including a convex portion 42*a* engageable with one of the concave portions 41*a* and 41*b* and a first biasing spring 43 that is a helical compression spring serving as a first biasing member applying a force to the first locking member 42. The first locking member 42 is shaped into an arm and the convex portion 42*a* is provided on a tip end of the first locking member 42. The first biasing spring 43 is provided on the opposite side of the first locking member 42 to the side on which the convex portion 42*a* is provided to contact the first locking member 42 so as to apply the biasing force to the first locking member 42 in a direction in which the convex portion 42*a* is engaged with the concave portion 41*a* or 41*b*.

As shown in FIG. 4, a hole 42*b* into which a boss 31*g* provided on the bottom plate 31*a* of the first rear end restriction member 31 is fitted is formed between the tip end and a proximal end of the first locking member 42. The first locking member 42 is supported by the first rear end restriction member 31 to be rotatable (movable) around this hole 42*b*.

A first operation portion 44 that can manipulate the first locking member 42 in a direction in which the convex portion 42*a* of the first locking member 42 is disengaged with one of the concave portions 41*a* and 41*b* formed in the cassette main body 1A against the biasing force of the first biasing spring 43 is provided on the proximal end of the first locking member 42 shown in FIG. 3. The first unlocking portion 34 includes the first operation portion 44. By manipulating the first operation portion 44, the first locking member 42 is moved in the direction in which the convex portion 42*a* of the first locking member 42 is disengaged with one of the concave portions 41*a* and 41*b*, thereby releasing locking of the first rear end restriction member 31 to the cassette main body 1A by the first locking member 42.

The first operation portion 44 can be turned and manipulated by user's gripping the first operation portion 44. The first operation portion 44 is arranged to be exposed from an opening H1 (FIG. 2) provided in the first wall 31*b*. By doing so, by user's manipulating the first operation portion 44, the first unlocking portion 34 can release the locking. In addition, the first rear end restriction member 31 can be easily slid while user's operating the first operation portion 44. When a user loses his or her grip on the first operation portion 44, the first locking member 42 rotates around the hole 42*b* by the biasing force of the first biasing spring 43 and the convex portion 42*a* can be engaged with the concave portion 41*a* or 41*b*. In this way, the first locking portion 33 can lock the first rear end restriction member 31 to the cassette main body 1A.

As shown in FIGS. 2 and 7, a rack tooth row 45 having many teeth along the sheet feeding direction is formed on the bottom plate 31*a* of the first rear end restriction member 31.

As shown in FIG. 7, the second locking portion 35 includes the rack tooth row 45, a second locking member 46 having a plurality of (three in FIG. 7) teeth 46*a* engageable with the rack tooth row 45, and a second biasing spring 47 that is a helical compression spring serving as a second biasing member applying a force to the second locking member 46.

A proximal end of the second locking member 46 is rotatably (movably) supported by the second rear end restriction member 32. The teeth 46*a* are formed on a tip end of the second locking member 46 on a surface of the second locking member 46 opposed to the rack tooth row 45 formed to extend upstream in the sheet feeding direction and formed on the bottom plate 31*a*. The second biasing spring 47 is provided to contact an opposite surface of the second locking member 46 to the surface on which the teeth 46*a* are provided so as to apply the biasing force to the second locking member 46 in a direction in which the teeth 46*a* of the second locking member 46 are engaged with the rack tooth row 45 provided on the bottom plate 31*a*. A projection 46*b* is formed near the proximal end of this second locking member 46. A second operation portion 48 that abuts on the projection 46*b* and that can manipulate the projection 46*b* in a direction of disengaging the teeth 46*a* of the second locking member 46 from the rack tooth row 45 against the biasing force of the second biasing spring 47 is rotatably (movably) supported by the second rear end restriction member 32. That is, the second unlocking portion 36 includes the second operation portion 48. By user's manipulating the second operation portion 48, the projection 46*b* of the second locking member 46 is pressed and moved in the direction of disengaging the teeth 46*a* of the second locking member 46 from the rack tooth row 45, thereby releasing locking done by the second locking member 46.

The second operation portion 48 can be turned and manipulated by user's gripping the second operation portion 48. The second operation portion 48 is arranged to be exposed from an opening H2 (FIG. 2) provided in the second wall 32*a*. By user's manipulating the second operation portion 48, the second unlocking portion 36 can release the locking. In addition, the second rear end restriction member 32 can be easily slid while user's operating the second operation portion 48. When the user loses his or her grip on the second operation portion 48, the second locking member 46 rotates by the biasing force of the second biasing spring 47 and the teeth 46*a* can be engaged with the rack tooth row 45. In this way, the second locking portion 35 can lock the second rear end restriction member 32 to the first rear end restriction member 31.

A click member, not shown, is provided at a position fit to each sheet size on the second rear end restriction member 32. Using the sense of "click", the user can position the second rear end restriction member 32 at a position fit to a specified sheet size.

Each tooth of the rack tooth row 45 formed on the bottom plate 31*a* is formed into a sawtooth shape. Each tooth 46*a* of the second locking member 46 is formed into a sawtooth shape engageable with the rack tooth row 45. A downstream surface of each tooth of the rack tooth row 45 in the sheet feeding direction is formed almost perpendicularly to the bottom plate 31*a*. An upstream surface of each tooth 46*a* of the second locking member 46 in the sheet feeding direction is formed almost perpendicularly to the bottom plate 31*a*. If the small-size sheets S apply a pressure to the second rear end restriction member 32 upstream in the sheet feeding direction, then the almost perpendicular surface of each tooth of the rack tooth row 45 abuts on that of each tooth 46*a* of the second locking member 46, and a high resisting force is generated. The second rear end restriction member 32 can thereby secure high retention strength and movement of the second rear end restriction member 32 upstream in the sheet feeding direction can be effectively suppressed when the small-size sheets S press the second rear end restriction member 32.

Second Embodiment

A second embodiment of the present invention will be described.

Figure 8:
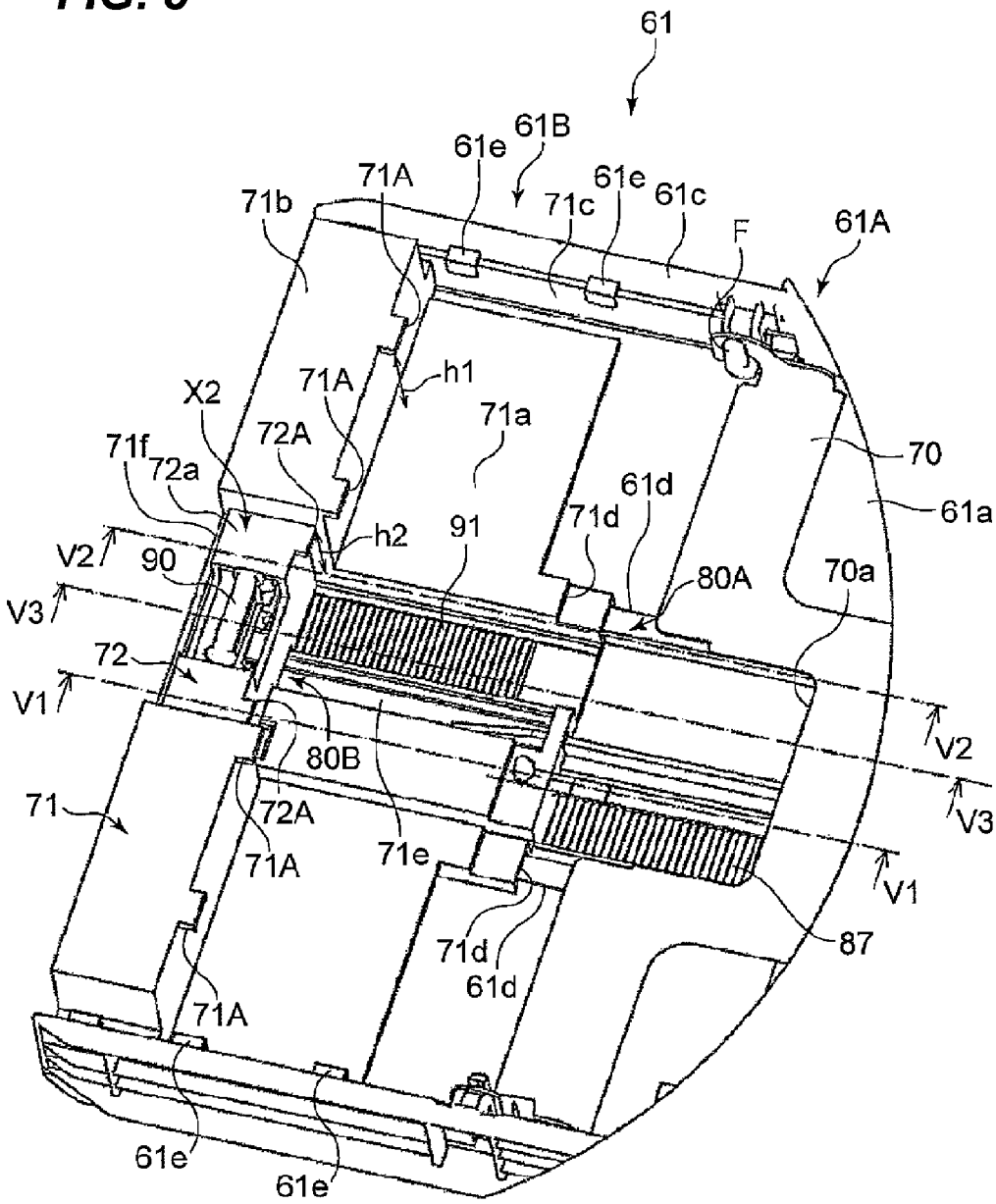
FIG. 8 is an explanatory diagram illustrating a sheet cassette of a printer as one example of an image forming apparatus according to a second embodiment of the present invention.

FIG. 8 is an explanatory diagram illustrating a sheet cassette of a printer as one example of an image forming apparatus according to the second embodiment of the present invention.

A sheet cassette 61 includes a cassette main body 61A, a rear end restriction portion 61B, and an intermediate plate 70 supported by the cassette main body 61A so as to be able to lift and lower with a hook F provided on the cassette main body 61A used as a fulcrum. The sheet cassette 61 also includes pressure springs, not shown, arranged between the cassette main body 61A and the intermediate plate 70 and serving as biasing members each applying a force to the intermediate plate 70 against a sheet feeding roller, not shown. The pressure springs apply biasing forces to this intermediate plate 70, thereby enabling a tip end of each of sheets loaded in the cassette main body 61A to be pressed against a sheet feeding roller, not shown, and assisting in a sheet feeding operation.

The cassette main body 61A includes a generally rectangular bottom plate 61*a*, a tip end wall, not shown, provided upright with respect to the bottom plate 61*a* and abutting on the tip end of each sheet, and sidewalls 61*c* provided upright on both sides, respectively in a width direction orthogonal to a sheet feeding direction. The cassette main body 61A has an open rear end and a rear end restriction portion 61B is provided on this rear end.

The rear end restriction portion 61B includes a first rear end restriction member 71 that restricts a rear end of each sheet of a predetermined size ("large-size sheet") loaded on the intermediate plate 70, and a second rear end restriction member 72 that restricts a rear end of each small-size sheet of a size smaller than the predetermined size loaded on the intermediate plate 70. That is, the second rear end restriction member 72 is for restricting the rear end of the sheet of the size smaller than that of the sheet restricted by the first rear end restriction member 71 when the small-size sheet is loaded in the cassette main body 61A. The first rear end restriction member 71 is provided on the cassette main body 61A movably in the sheet feeding direction. The second rear end restriction member 72 is provided on the first rear end restriction member 71 movably in the sheet feeding direction.

The first rear end restriction member 71 includes a bottom plate 71*a* formed to extend toward the cassette main body 61A and supporting the rear end of each sheet and a first wall 71*b* provided upright on the bottom plate 71*a* for abutting on the rear end of the sheet. The first wall 71*b* has a notch X2 formed almost at the center of the first wall 71*b* in the width direction. Further, the first rear end restriction member 71 includes arms 71*c* formed on both sides of the first rear end restriction member 71, in the width direction orthogonal to the sheet feeding direction.

The second rear end restriction member 72 includes a second wall 72*a* located on the bottom plate 71*a* and arranged almost in a central portion of the bottom plate 71*a* in the width direction to be slidable in the sheet feeding direction for abutting on the rear end of the sheet. The second wall 72*a* of this second rear end restriction member 72 is arranged at a position corresponding to the notch X2 of the first wall 71*b* (so as not to overlap with the first wall 71*b*). Even if the second wall 72*a* slides, the second wall 72*a* is designed not to contact the first wall 71*b*. By so configuring, the second rear end restriction member 72 is out of contact with the first wall 71*b* even if the second rear end restriction member 72 is retracted upstream of the first wall 71*b* in the sheet feeding direction. A stopper 71*f* preventing detachment of the second rear end restriction member 72 is provided in the notch X2.

In this second embodiment, the sheet cassette 61 includes a first slide mechanism 80A that slides the first rear end restriction member 71 relatively to the cassette main body 61A along the sheet feeding direction. The sheet cassette 61 also includes a second slide mechanism 80B that slides the second rear end restriction member 72 relatively to the first rear end restriction member 71 along the sheet feeding direction.

Convex portions 61*d* extending in the sheet feeding direction are formed on the bottom plate 61*a* of the cassette main body 61A so as to guide the bottom plate 71*a* of the first rear end restriction member 71. Further, projections 61*e* supporting the arms 71*c* of the first rear end restriction member 71 and guiding the first rear end restriction member 71 to move in the sheet feeding direction are formed inside each of the sidewalls 61*c*. Guide grooves 71*d* which extend in the sheet feeding direction and into which the convex portions 61*d* are slidably fitted are formed on a lower surface of the bottom plate 71*a* of the first rear end restriction member 71. The first rear end restriction member 71 is thereby slidable on the bottom plate 61*a* relatively to the cassette main body 61A along the sheet feeding direction while being guided by the convex portion 61*d* and the projections 61*e* provided on the cassette main body 61A. That is, the convex portion 61*d*, the guide groove 71*d*, the projections 61*e* and the arms 71*c* constitute the first slide mechanism 80A.

A guide groove 71*e* extending from a downstream end of the bottom plate 71*a* of the first rear end restriction member 71 in the sheet feeding direction to a position corresponding to the notch X2 of the first wall 71*b* is provided on the bottom plate 71*a*.

Further, a convex portion, not shown, slidably fitted into the guide groove 71*e* arranged on the bottom plate 71*a* of the first rear end restriction member 71 is formed on the second wall 72*a* of the second rear end restriction member 72. Therefore, the second rear end restriction member 72 can slide on the bottom plate 71*a* of the first rear end restriction member 71 along the sheet feeding direction while being guided by the guide groove 71*e*. That is, the guide groove 71*e* and the convex portion, not shown, constitute the second slide mechanism 80B.

The first slide mechanism 80A and the second slide mechanism 80B can move the first rear end restriction member 71 and the second rear end restriction member 72 to appropriate positions in the sheet feeding directions, respectively. Only by sliding the first rear end restriction member 71 and the second rear end restriction member 72 as stated above, the rear ends of sheets of various sizes can be restricted.

A slit 70*a* into which the second rear end restriction member 72 enters is formed in the intermediate plate 70.

In the second embodiment, the first rear end restriction member 71 includes first height restriction pieces 71A provided on an upper end of the first wall 71*b*, protruding toward the cassette main body 61A and serving as first height restriction portions that restrict a height of the loaded sheets to a first height h1. That is, each first height restriction piece 71A of the first rear end restriction member 71 is provided at a height position at which a sheet feeding pressure falls in a constant range fit to the large-size sheets.

The second rear end restriction member 72 includes second height restriction pieces 72A provided on an upper end of the second wall 72*a*, protruding toward the cassette main body 61A and serving as second height restriction portions that restrict the height of the loaded sheets to a second height h2 smaller than the first height h1. That is, each second height restriction piece 72A is provided at a position lower than the first height restriction pieces 71A and at a height position at which the sheet feeding pressure falls in a constant range fit to the small-size sheets so that the height of the small-size sheets loaded on the intermediate plate 70 is smaller than that of the large-size sheets loaded thereon.

In this way, the first height restriction pieces 71A of the first rear end restriction member 71 and the second height restriction pieces 72A of the second rear end restriction member 72 can restrict the height of the loaded sheets according to the sheets of various sizes, that is, the large-size sheets and the small-size sheets, respectively. Therefore, the sheet feeding pressure acting on the sheet feeding roller, not shown, can be kept in the constant range fit to the sheets of each size and such sheet feeding failures as multiple-feeding of sheets and non-feeding of sheets can be prevented. Furthermore, only by sliding the first rear end restriction member 71 and the second rear end restriction member 72 without detaching or attaching the first rear end restriction member 71 and the second rear end restriction member 72, restricted positions can be set in a stepless fashion and usability can be improved.

Meanwhile, the second embodiment differs from the first embodiment in mechanisms of locking the first rear end restriction member 71 and the second rear end restriction member 72.

Figure 9:
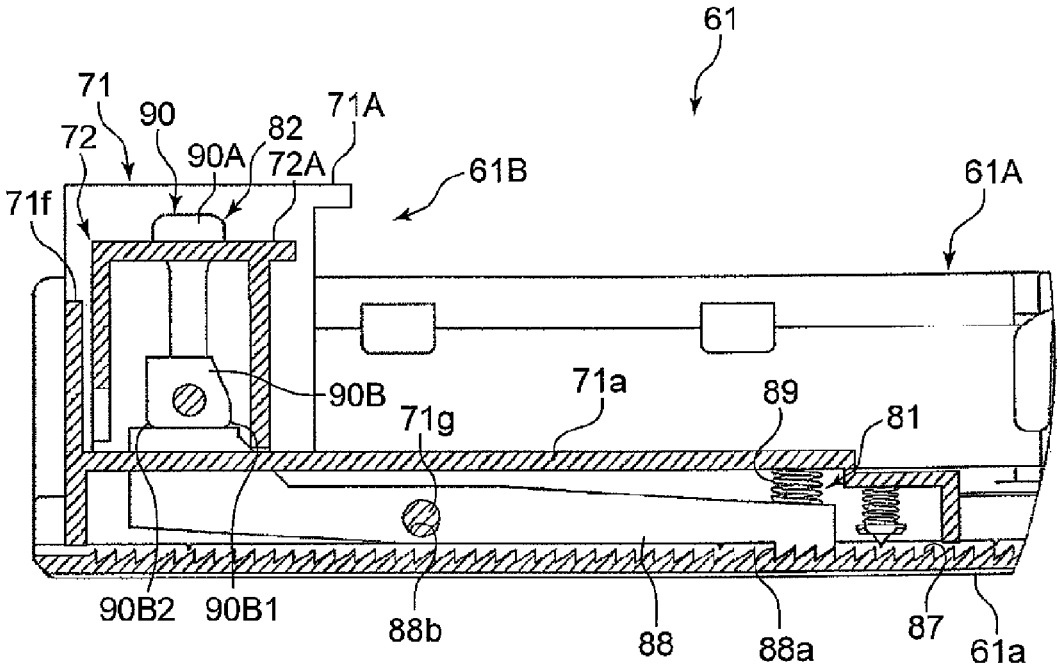
FIG. 9 is a cross-sectional view taken along a line V1-V1 of FIG. 8 and illustrating a mechanism of locking a first rear end restriction member to a cassette main body according to the second embodiment.
Figure 10:
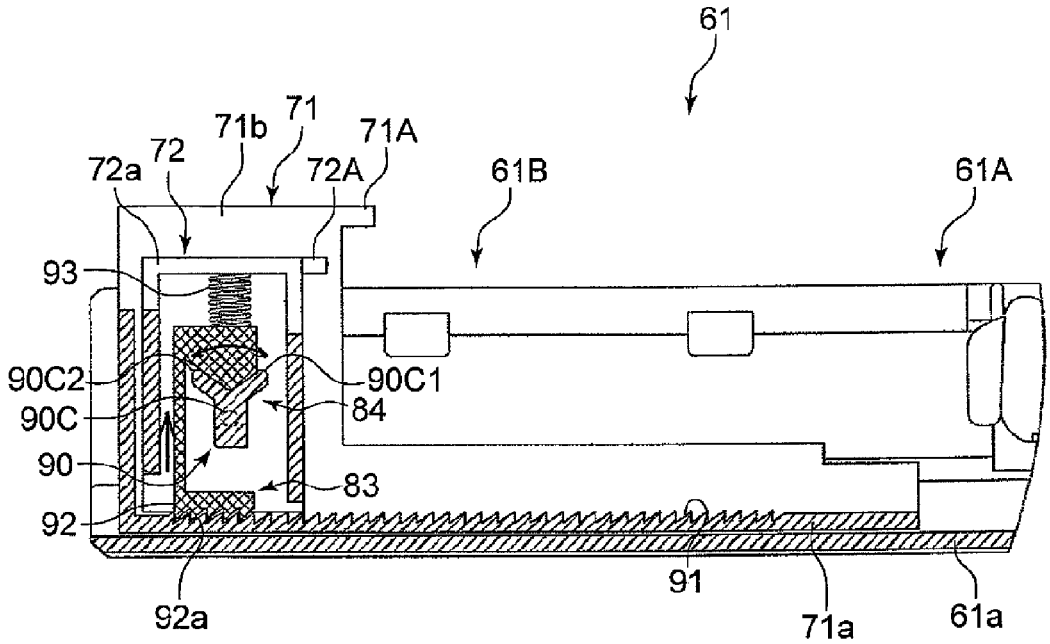
FIG. 10 is a cross-sectional view taken along a line V2-V2 of FIG. 8 and illustrating a mechanism of locking a second rear end restriction member to the first rear end restriction member according to the second embodiment.
Figure 11:
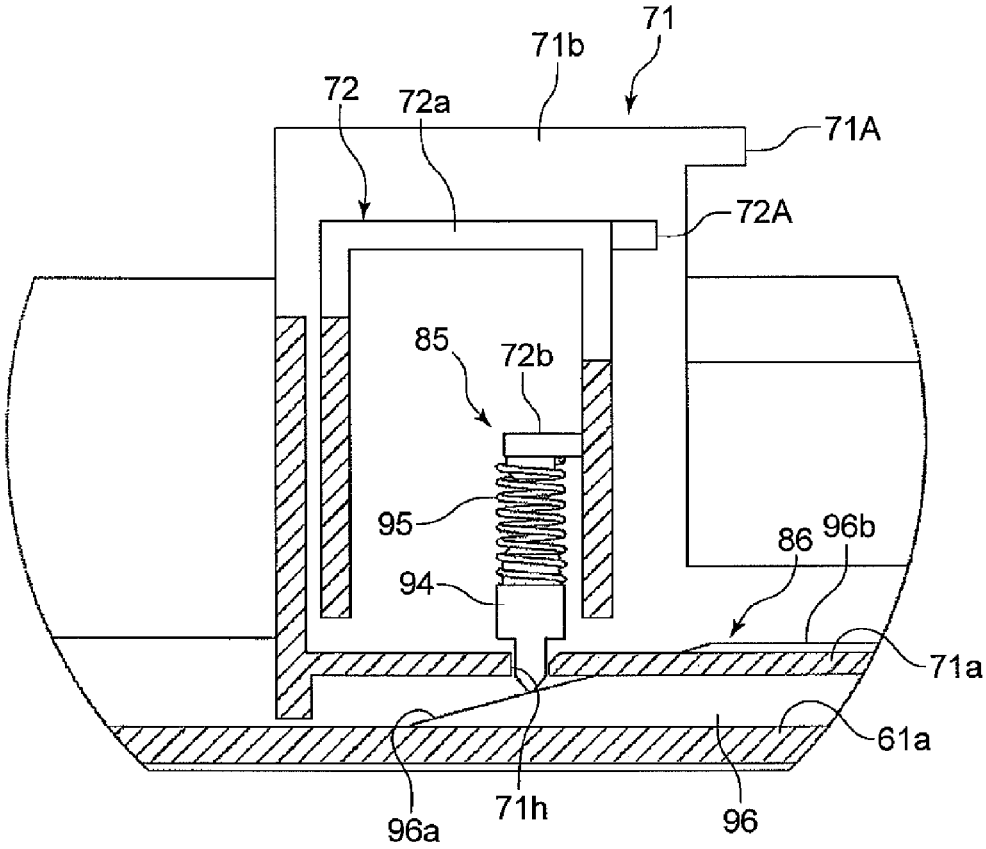
FIG. 11 is a cross-sectional view taken along a line V3-V3 of FIG. 8 and illustrating a mechanism of connecting the second rear end restriction member to the first rear end restriction member according to the second embodiment.

In the second embodiment, the first rear end restriction member 71 and the second rear end restriction member 72 are configured to be able to be locked to each other so as not to move after being positioned. FIG. 9 is a cross-sectional view taken along a line V1-V1 of FIG. 8 and illustrating a mechanism of locking the first rear end restriction member 71 to the cassette main body 61A according to the second embodiment. FIG. 10 is a cross-sectional view taken along a line V2-V2 of FIG. 8 and illustrating a mechanism of locking the second rear end restriction member 72 to the first rear end restriction member 71 according to the second embodiment. FIG. 11 is a cross-sectional view taken along a line V3-V3 of FIG. 8 and illustrating a mechanism of connecting the second rear end restriction member 72 to the first rear end restriction member 71 according to the second embodiment.

As shown in FIG. 9, the sheet cassette 61 includes a first locking portion 81 locking the first rear end restriction member 71 to the bottom plate 61*a* of the cassette main body 61A, and a first unlocking portion 82 that can release locking done by the first locking portion 81.

As shown in FIG. 10, the sheet cassette 61 also includes a second locking portion 83 locking the second rear end restriction member 72 to the bottom plate 71*a* of the first rear end restriction member 71, and a second unlocking portion 84 that can release locking done by the second locking portion 83.

As shown in FIG. 11, the sheet cassette 61 further includes a connection portion 85 connecting the second rear end restriction member 72 to the bottom plate 71*a* of the first rear end restriction member 71 when the second rear end restriction member 72 is retracted upstream of the first wall 71*b* of the first rear end restriction member 71 in the sheet feeding direction. The sheet cassette 61 also includes a connection release portion 86 releasing connection made by the connection portion 85 when the first rear end restriction member 71 is moved to a downstream end thereof in the sheet feeding direction in a moving range of the first rear end restriction member 71 in the sheet feeding direction.

As shown in FIGS. 9 to 11, the second wall 72*a* of the second rear end restriction member 72 is formed into a hollow box shape having an open lower portion.

Configurations of the first locking portion 81 and the first unlocking portion 82 will first be described in detail.

As shown in FIG. 9, a rack tooth row 87 having many teeth along the sheet feeding direction is formed on the bottom plate 61*a* of the cassette main body 61A.

The first locking portion 81 includes the rack tooth row 76 of the cassette main body 61A and an arm-shaped first locking member 88 including a plurality of (three in FIG. 9) teeth 88*a* engageable with the rack tooth row 87. The first locking portion 81 also includes a first biasing spring 89 that is a helical compression spring serving as a first biasing member applying a force to the first locking member 88 so that the teeth 88*a* of the first locking member 88 are engaged with the rack tooth row 87 of the cassette main body 61A.

The teeth 88*a* are formed on a tip end of the first locking member 88 on a surface of the first locking member 88 opposed to the rack tooth row 87, and the first biasing spring 89 is provided on an opposite surface of the first locking member 88 to the surface on which the teeth 88*a* are provided so as to contact the opposite surface. The first biasing spring 89 thereby applies the biasing force to the first locking member 88 in the direction in which the teeth 88*a* of the first locking member 88 are engaged with the rack tooth row 87.

A hole 88*b* into which a shaft 71*g* of the first rear end restriction member 71 is fitted is formed between the tip end and a proximal end of the first locking member 88. The first locking member 88 is supported by the first rear end restriction member 71 to be rotatable (movable) around the hole 88*b*.

Furthermore, the sheet cassette 61 includes an operation lever 90. This operation lever 90 includes a lever main body 90A and a first cam member 90B that includes two cams 90B1 and 90B2 formed near a rotational center of the operation lever 90. The first cam member 90B constitutes a first operation portion.

A tip end of the lever main body 90A of the operation lever 90 is arranged to be exposed from the second wall 72*a* of the second rear end restriction member 72, whereby a user can manipulate the operation lever 90. The first cam member 90B is fixed to a proximal end of the lever main body 90A and arranged in the second wall 72*a*.

That is, the user can manipulate the first cam member 90B of the operation lever 90 using the lever main body 90A attached integrally with the first cam member 90B. The first cam member 90B rotates integrally with the lever main body 90A, whereby the first cam member 90B can manipulate the first locking member 88 in a direction in which the teeth 88*a* of the first locking member 88 are disengaged from the rack tooth row 87 of the cassette main body 61A against the biasing force of the first biasing spring 89.

The first cam member 90B of this operation lever 90 is supported by the second rear end restriction member 72 to be rotatably manipulable. The first cam member 90B moves integrally with the second rear end restriction member 72 when sliding the second rear end restriction member 72. Following slidable movement of this second rear end restriction member 72, the first cam member 90B of the operation lever 90 contacts with or separates from the proximal end of the first locking member 88.

The first cam member 90B of the operation lever 90 abuts on the proximal end of the first locking member 88 when the second rear end restriction member 72 is retracted upstream of the first wall 71*b* of the first rear end restriction member 71 in the sheet feeding direction. In this way, by abutting the first cam member 90B of the operation lever 90 on the proximal end of the first locking member 88, the user can manipulate the first locking member 88 using the operation lever 90 and release locking of the first rear end restriction member 71 on the cassette main body 61A by the first locking member 88. Specifically, if the user manipulates the lever main body 90A of the operation lever 90 to move the lever main body 90A to a release operation position upstream or downstream in the sheet feeding direction, the first cam member 90B rotates. The cam 90B1 or 90B2 presses down the proximal end of the first locking member 88, the first locking member 88 rotates around the shaft 71*g* and the teeth 88*a* of the first locking member 88 are separated from the rack tooth row 87, thereby releasing locking done by the first locking portion 81.

In this way, the first rear end restriction member 71 can slide along with the second rear end restriction member 72 in the sheet feeding direction while the first cam member 90B is manipulated via the lever main body 90A of the operation lever 90 to unlock the first rear end restriction member 71.

The lever main body 90A is returned to a reference position (FIG. 9), whereby the first locking member 88 rotates, pressing of the first cam member 90B on the first locking member 88 is released and the teeth 88*a* of the first locking member 88 are engaged with the rack tooth row 87. The first rear end restriction member 71 is thereby locked to the cassette main body 61A.

Each tooth of the rack tooth row 87 formed on the bottom plate 61*a* of the cassette main body 61A is formed into a sawtooth shape. Each tooth 88*a* of the first locking member 88 is formed into a sawtooth shape engageable with the rack tooth row 87.

A downstream surface of each tooth of the rack tooth row 87 in the sheet feeding direction is formed almost perpendicularly to the bottom plate 61*a*. An upstream surface of each tooth 88*a* of the first locking member 88 in the sheet feeding direction is formed almost perpendicularly to the bottom plate 61*a*. If the large-size sheets apply a pressure to the first rear end restriction member 71 upstream in the sheet feeding direction, then the almost perpendicular surface of each tooth of the rack tooth row 87 abuts on that of each tooth 88*a* of the first locking member 88, and a high resisting force is generated. The first rear end restriction member 71 can thereby secure high retention strength and movement of the first rear end restriction member 71 upstream in the sheet feeding direction can be effectively suppressed when the large-size sheets press the first rear end restriction member 71.

Configurations of the second locking portion 83 and the second unlocking portion 84 shown in FIG. 10 will be described in detail.

A rack tooth row 91 having many teeth along the sheet feeding direction is formed on the bottom plate 71*a* of the first rear end restriction member 71.

The second locking portion 83 includes the rack tooth row 91 of the first rear end restriction member 71 and an arm-shaped second locking member 92 having a plurality of (five in FIG. 10) teeth 92*a* engageable with the rack tooth row 91. The second locking portion 83 also includes a second biasing spring 93 that is a helical compression spring serving as a second biasing member applying a force to the second locking member 92 so that the teeth 92*a* of the second locking member 92 are engaged with the rack tooth row 91 of the first rear end restriction member 71.

The second locking member 92 is formed to have a generally U-shaped cross section. The teeth 92*a* are formed on a tip end of the second locking member 92 on a surface of the second locking member 92 opposed to the rack tooth row 91. One end of the second biasing spring 93 is provided on a proximal end of the second locking member 92 to contact the proximal end thereof. The other end of the second biasing spring 93 is fixed to an internal surface of the second wall 72*a*. The second biasing spring 93 thereby applies the biasing force to the second locking member 92 in a direction in which the teeth 92*a* of the second locking member 92 are engaged with the rack tooth row 91.

The operation lever 90 includes a second cam member 90C serving as a second operation portion that can manipulate the second locking member 92 in a direction in which the teeth 92*a* of the second locking member 92 are disengaged from the rack tooth row 91 on the bottom plate 71*a* of the first rear end restriction member 71 against the biasing force of the second biasing spring 93. This second cam member 90C is connected to the first cam member 90B (see FIG. 9) and manipulated integrally with the first cam member 90B. That is, when the user manipulates the lever main body 90A, the first cam member 90B and the second cam member 90C are manipulated integrally.

The second locking member 92, the second biasing spring 93 and the second cam member 90C are arranged within the second wall 72*a* of the second rear end restriction member 72. The second locking member 92 is supported by the second wall 72*a* vertically movably by nipping the proximal end of the second locking member 92 between the second cam member 90C and the second biasing spring 93.

Two cams 90C1 and 90C2 are formed on the second cam member 90C. By user's manipulating the lever main body 90A (see FIG. 9), the second cam member 90C rotates. The cam 90C1 or 90C2 presses up the proximal end of the second locking member 92, the second locking member 92 moves upward and the teeth 92*a* of the second locking member 92 are separated from the rack tooth row 91, thereby releasing locking done by the second locking portion 83.

The lever main body 90A is returned to the reference position (FIG. 9), whereby pressing of the second cam member 90C on the second locking member 92 is released, the second locking member 92 moves downward and the teeth 92*a* of the second locking member 92 are engaged with the rack tooth row 91. The second rear end restriction member 72 is thereby locked to the first rear end restriction member 71.

Each tooth of the rack tooth row 91 formed on the bottom plate 71*a* of the first rear end restriction member 71 is formed into a sawtooth shape. Each tooth 92*a* of the second locking member 92 is formed into a sawtooth shape engageable with the rack tooth row 91. A downstream surface of each tooth of the rack tooth row 91 in the sheet feeding direction is formed almost perpendicularly to the bottom plate 71*a*. An upstream surface of each tooth 92*a* of the second locking member 92 in the sheet feeding direction is formed almost perpendicularly to the bottom plate 71*a*. If the small-size sheets apply a pressure to the second rear end restriction member 72 upstream in the sheet feeding direction, then the almost perpendicular surface of each tooth of the rack tooth row 91 abuts on that of each tooth 92*a* of the second locking member 92, and a high resisting force is generated. The second rear end restriction member 72 can thereby secure high retention strength and movement of the second rear end restriction member 72 upstream in the sheet feeding direction can be effectively suppressed when the small-size sheets press the second rear end restriction member 72.

The connection portion 85 and the connection release portion 86 shown in FIG. 11 will be described in detail.

A through-hole 71*h* opposed to the second wall 72*a* of the second rear end restriction member 72 when the second rear end restriction member 72 is retracted upstream of the first wall 71*b* in the sheet feeding direction is formed in the bottom plate 71*a* of the first rear end restriction member 71.

The connection portion 85, which is provided on the second wall 72*a*, includes a protrusion member 94 insertable into the through-hole 71*h* when the second rear end restriction member 72 is retracted upstream of the first wall 71*b* in the sheet feeding direction. The connection portion 85 also includes a protrusion biasing spring 95 that is a helical compression spring serving as a protrusion biasing member that applies a biasing force to the protrusion member 94 in a direction of the through-hole 71 (downward) so that the protrusion member 94 protrudes from the through-hole 71*h*.

A protrusion 72*b*, which is fixed to the second wall 72*a* and to which the protrusion biasing spring 95 is fixed, is formed inside the second wall 72*a*. That is, a proximal end of the protrusion biasing spring 95 is fixed to the protrusion 72*b* and the protrusion member 94 is provided on the tip end of the protrusion biasing spring 95. The protrusion member 94 is pressed by the protrusion biasing spring 95 and can thereby protrude from the through-hole 71*h* if the protrusion member 94 is opposed to the through-hole 71*h*.

If the protrusion member 94 protrudes from the through-hole 71*h*, then the second rear end restriction member 72 is locked to the first rear end restriction member 71, and the first rear end restriction member 71 and the second rear end restriction member 72 can slide integrally while being connected to each other.

The connection release portion 86 includes a rib 96 provided on the bottom plate 61*a* of the cassette main body 61A so as to abut on a tip end of the protrusion member 94 and having an inclined surface 96*a* inclined to be closer to the second rear end restriction member 72 downstream in the sheet feeding direction.

This rib 96 has an upper end surface 96*b* extending from the inclined surface 96*a* downstream in the sheet feeding direction and set to be located at a higher position than an upper surface of the bottom plate 71*a* of the first rear end restriction member 71.

By so configuring the connection release portion 86, when the first rear end restriction member 71 slides downstream in the sheet feeding direction in a state in which the first rear end restriction member 71 is connected to the second rear end restriction member 72, the protrusion member 94 is pressed upward by the inclined surface 96*a* against the biasing force of the protrusion biasing spring 95. When the first rear end restriction member 71 slides up to a downstream end thereof in the sheet feeding direction in a moving range thereof, the protrusion member 94 rides on and abuts on the upper end surface 96*b*. The protrusion member 94 is thereby detached from the through-hole 71*h* and connection made by the connection portion 85 is released.

An instance of sliding the first rear end restriction member 71 and the second rear end restriction member 72 will be described in detail.

A state of connecting the first rear end restriction member 71 to the second rear end restriction member 72 by the connection portion 85 will first be described. By user's manipulating the lever main body 90A of the operation lever 90 shown in FIG. 9, the locking between the cassette main body 61A and the first rear end restriction member 71 is released.

At this time, the locking between the first rear end restriction member 71 and the second rear end restriction member 72 is also released. However, since the connection portion 85 shown in FIG. 11 connects the first rear end restriction member 71 to the second rear end restriction member 72, the second rear end restriction member 72 is immovable relatively to the first rear end restriction member 71. Accordingly, by user's manipulating the operation lever 90, the first rear end restriction member 71 and the second rear end restriction member 72 slide integrally.

At this time, the second wall 72*a* and the second height restriction pieces 72A of the second rear end restriction member 72 are retracted upstream of the first wall 71*b* of the first rear end restriction member 71 in the sheet feeding direction. Therefore, if large-size sheets are loaded on the intermediate plate 70, the second wall 72*a* and the second height restriction pieces 72A are out of contact with rear ends of the sheets when the first wall 71*b* of the first rear end restriction member 71 restricts the rear ends of the sheets. Furthermore, the first height restriction pieces 71A provided on the first rear end restriction member 71 can restrict the height of the loaded large-size sheets to the first height h1.

If the first rear end restriction member 71 slides to the downstream end thereof in the sheet feeding direction in the moving range thereof, the protrusion member 94 shown in FIG. 11 is pressed upward by the inclined surface 96*a*. Thereafter, the protrusion member 94 is pressed by the upper end surface 96*b* on which the protrusion member 94 rides, whereby the protrusion member 94 is detached from the through-hole 71*h*. The connection between the first rear end restriction member 71 and the second rear end restriction member 72 is thereby released.

Figure 12:
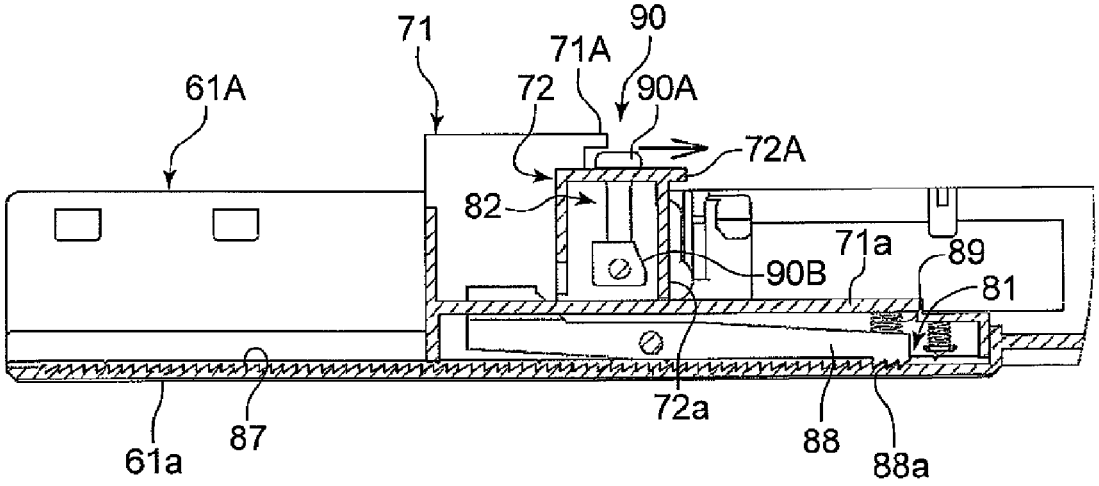
FIG. 12 is an explanatory diagram illustrating a moving state of the second rear end restriction member if connection between the first rear end restriction member and the second rear end restriction member is released according to the second embodiment.

FIG. 12 is an explanatory diagram illustrating a moving state of the second rear end restriction member 72 if the connection between the first rear end restriction member 71 and the second rear end restriction member 72 is released.

Since the first rear end restriction member 71 moves to the downstream end thereof in the sheet feeding direction in the moving range thereof, movement of the first rear end restriction member 71 downstream in the sheet feeding direction is restricted and the first rear end restriction member 71 is immovable. Since the second rear end restriction member 72 is disconnected from the first rear end restriction member 71, the second rear end restriction member 72 can slide downstream in the sheet feeding direction relative to the first rear end restriction member 71 in an arrow direction shown in FIG. 12. By manipulating the lever main body 90A of the operation lever 90, the locking done by the second locking member 83 shown in FIG. 10 is released and the second rear end restriction member 72 can slide as shown in FIG. 12.

In this way, by sliding the second rear end restriction member 72, the proximal end of the first locking member 88 is separated from the first cam member 90B. This makes the first locking member 88 non-manipulable and maintains the state in which the teeth 88*a* of the first locking member 88 are engaged with the rack tooth row 87. That is, the state in which the first rear end restriction member 71 is locked to the cassette main body 61A is maintained.

The user then manipulates the lever main body 90A of the operation lever 90 while the first rear end restriction member 71 is locked to the cassette main body 61A, whereby the second rear end restriction member 72 can slide. The second height restriction pieces 72A provided on the second rear end restriction member 72 can restrict the height of the loaded small-size sheets to the second height h2.

By retracting the second rear end restriction bodly 72 upstream of the first wall 71*b* in the sheet feeding direction, the proximal end of the first locking member 88 contacts the first cam member 90B and the user can manipulate the first locking member 88 via the operation lever 90. In this way, by contacting the proximal end of the first locking member 88 with the first cam member 90B, the locking done by the first locking portion 81 can be released by user's manipulating the lever main body 90A of the operation lever 90.

Furthermore, in this state, the second rear end restriction member 72 as well as the first rear end restriction member 71 is moved upstream in the sheet feeding direction while the user manipulates the operation lever 90. The protrusion member 94 of the connection portion 85 thereby protrudes from the through-hole 71*h* and the second rear end restriction member 72 is connected to the first rear end restriction member 71.

As stated so far, according to the second embodiment, the connection portion 85 connects the second rear end restriction member 72 to the first rear end restriction member 71. By doing so, the first rear end restriction member 71 and the second rear end restriction member 72 move integrally when the rear end restriction portion 61B is fit to the rear ends of the large-size sheets. It is, therefore, possible to prevent the user from erroneously moving the second rear end restriction member 72 downstream of the first rear end restriction member 71 in the sheet feeding direction when the rear end restriction portion 61B is fit to the rear ends of the large-size sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet feeding device comprising:

a sheet cassette in which a sheet is loaded; and a sheet feeding roller which feeds the sheet loaded in the sheet cassette, wherein the sheet cassette includes a cassette main body;

a supporting plate which is provided in the cassette main body to be able to lift and lower, and which supports the sheets loaded in the cassette main body;

a biasing member which biases the supporting plate toward the sheet feeding roller so as to press a tip end of the sheets against the sheet feeding roller;

a first rear end restriction member provided movably along a sheet feeding direction and which restricts a rear end of the sheet loaded in the cassette main body;

a first slide mechanism which slides the first rear end restriction member on the cassette main body;

a second rear end restriction member provided at a position offset from the first rear end restriction member in a width direction of the loaded sheets and movable along a sheet feeding direction and which restricts the rear end of the sheet loaded in the cassette main body;

a second slide mechanism which slides the second rear end restriction member on the first rear end restriction member;

a notch provided on the first rear end restriction member in which the second rear end restriction member is retracted, in a state that the sheet cassette is extended to load large-size sheets, the second rear end restriction member is retracted in the notch and the sheets loaded in the sheet cassette is restricted by the first rear end restriction member, in a state that the sheet cassette is shortened to load small-size sheets, the sheet loaded in the sheet cassette is restricted by the second rear end restriction member;

a first height restriction portion provided on the first rear end restriction member which restricts a height of a sheet of a predetermined size loaded in the cassette main body by a first height; and a second height restriction portion provided on the second rear end restriction member which restricts a height of a sheet of a size smaller than the predetermined size loaded in the cassette main body by a second height lower than the first height, wherein when the rear ends of the loaded sheets are restricted by the first rear end restriction member, the second rear end restriction member is retracted from the first rear end restriction member so that the second height restriction portion of the second rear end restriction member does not contact the rear ends of the loaded sheets.

2. The sheet feeding device according to claim 1, wherein the first rear end restriction member includes a first wall which restricts the rear end of the sheet, and the second rear end restriction member includes a second wall which restricts the rear end of the sheet;

the first height restriction portion is provided on the first wall to protrude to an inside of the cassette main body; and the second height restriction portion is provided on the second wall to protrude to an inside of the cassette main body.

3. The sheet feeding device according to claim 2, further comprising:

a first locking portion which locks the first rear end restriction member;

a first unlocking portion that releases locking done by the first locking portion;

a second locking portion which locks the second rear end restriction member; and a second unlocking portion that releases locking done by the second locking portion.

4. The sheet feeding device according to claim 3, wherein the first unlocking portion is configured to release the locking done by the first locking portion when the second rear end restriction member is retracted upstream of the first wall in the sheet feeding direction.

5. The sheet feeding device according to claim 4, wherein the cassette main body includes a plurality of teeth formed along the sheet feeding direction, the first locking portion includes:

a first locking member provided movably in the first rear end restriction member and which includes teeth engageable with the teeth of the cassette main body; and a first biasing member which applies a force to the first locking member so as to engage the teeth of the first locking member with the teeth of the cassette main body, the first unlocking portion includes:

a first operation portion which can manipulate the first locking member in a direction of disengaging the teeth of the first locking member from the teeth of the cassette main body against the biasing force of the first biasing member, when the second rear end restriction member is retracted upstream of the first wall in the sheet feeding direction.

6. The sheet feeding device according to claim 5, wherein the first rear end restriction member provided movably on the cassette main body and the second rear end restriction member provided movably on a bottom plate of the first rear end restriction member, and the bottom plate includes a plurality of teeth formed along the sheet feeding direction, the second locking portion includes:

a second locking member provided movably in the second rear end restriction member, and including teeth engageable with the teeth of the bottom plate; and a second biasing member which applies a force to the second locking member so as to engage the teeth of the second locking member with the teeth of the bottom plate, the second unlocking portion includes a second operation portion which can manipulate the second locking member in a direction of disengaging the teeth of the second locking member from the teeth of the bottom plate against the biasing force of the second biasing member.

7. The sheet feeding device according to claim 4, wherein the first rear end restriction member provided movably on the cassette main body and the second rear end restriction member provided movably on a bottom plate of the first rear end restriction member, further comprising:

a connection portion which connects the second rear end restriction member to the bottom plate when the second rear end restriction member is retracted upstream of the first wall in the sheet feeding direction; and a connection release portion which releases connection made by the connection portion when the first rear end restriction member is moved to a downstream end of the first rear end restriction member in the sheet feeding direction in a moving range of the first rear end restriction member.

8. The sheet feeding device according to claim 7, wherein the bottom plate includes a through-hole formed to be opposed to the second rear end restriction member when the second rear end restriction member is retracted upstream of the first wall in the sheet feeding direction, the connection portion includes:

a protrusion member provided on the second rear end restriction member, and insertable into the through-hole when the second rear end restriction member is retracted upstream of the first wall in the sheet feeding direction; and a protrusion biasing member which applies a force to the protrusion member in a direction of the through-hole so that the protrusion member protrudes from the through-hole, the connection release portion includes a rib provided in the cassette main body so as to abut on a tip end of the protrusion member and which has an inclined surface formed downstream in the sheet feeding direction to be closer to the second rear end restriction member, the protrusion member protrudes from the through-hole to lock the second rear end restriction member to the first rear end restriction member, and the protrusion member is pressed by the inclined surface against the biasing force of the protrusion biasing member when the first rear end restriction member slides downstream in the sheet feeding direction, and the protrusion member is detached from the through-hole to release the connection of the second rear end restriction member to the bottom plate when the first rear end restriction member slides to the downstream end of the first rear end restriction member in the sheet feeding direction.

9. An image forming apparatus comprising:

a sheet cassette in which a sheet is loaded;

a sheet feeding roller which feeds the sheet loaded in the sheet cassette; and an image forming portion which forms an image on the sheet fed by the sheet feeding roller, wherein the sheet cassette includes:

a cassette main body;

a supporting plate which is provided in the cassette main body to be able to lift and lower, and which supports the sheets loaded in the cassette main body;

a biasing member which biases the supporting plate toward the sheet feeding roller so as to press a tip end of the sheets against the sheet feeding roller;

a first rear end restriction member provided movably along a sheet feeding direction and which restricts a rear end of the sheet loaded in the cassette main body;

a first slide mechanism which slides the first rear end restriction member on the cassette main body;

a second rear end restriction member provided at a position offset from the first rear end restriction member in a width direction of the loaded sheets and movable along a sheet feeding direction and which restricts the rear end of the sheet loaded in the cassette main body; and a second slide mechanism which slides the second rear end restriction member on the first rear end restriction member;

a notch provided on the first rear end restriction member in which the second rear end restriction member is retracted, in a state that the sheet cassette is extended to load large-size sheets, the second rear end restriction member is retracted in the notch and the sheets loaded in the sheet cassette is restricted by the first rear end restriction member, in a state that the sheet cassette is shortened to load small-size sheets, the sheet loaded in the sheet cassette is restricted by the second rear end restriction member, a first height restriction portion provided on the first rear end restriction member which restricts a height of a sheet of a predetermined size loaded in the cassette main body by a first height, and a second height restriction portion provided on the second rear end restriction member which restricts a height of a sheet of a size smaller than the predetermined size loaded in the cassette main body by a second height lower than the first height, wherein when the second rear end restriction member is retracted in the notch the second height restriction portion of the second rear end restriction member does not contact the rear ends of the loaded sheets.

10. The image forming apparatus according to claim 9, wherein the first rear end restriction member includes a first wall provided upright with respect to a bottom plate of the first rear end restriction member which abuts on the rear end of the sheet, and the second rear end restriction member includes a second wall slidably provided on the bottom plate which abuts on the rear end of the sheet;

the first height restriction portion is provided on the first wall to protrude to an inside of the cassette main body; and the second height restriction portion is provided on the second wall to protrude to an inside of the cassette main body.

11. The image forming apparatus according to claim 10, further comprising:

a first locking portion which locks the first rear end restriction member;

a first unlocking portion that releases locking done by the first locking portion;

a second locking portion which locks the second rear end restriction member; and a second unlocking portion that releases locking done by the second locking portion.

12. The image forming apparatus according to claim 11, wherein the first unlocking portion is configured to release the locking done by the first locking portion when the second rear end restriction member is retracted upstream of the first wall in the sheet feeding direction.

13. The image forming apparatus according to claim 12, wherein the cassette main body includes a plurality of teeth formed along the sheet feeding direction, the first locking portion includes:

a first locking member provided movably in the first rear end restriction member and which includes teeth engageable with the teeth of the cassette main body; and a first biasing member which applies a force to the first locking member so as to engage the teeth of the first locking member with the teeth of the cassette main body, the first unlocking portion includes a first operation portion which can manipulate the first locking member in a direction of disengaging the teeth of the first locking member from the teeth of the cassette main body against the biasing force of the first biasing member, when the second rear end restriction member is retracted upstream of the first wall in the sheet feeding direction.

14. The image forming apparatus according to claim 13, wherein the first rear end restriction member provided movably on the cassette main body and the second rear end restriction member provided movably on a bottom plate of the first rear end restriction member, and the bottom plate includes a plurality of teeth formed along the sheet feeding direction, the second locking portion includes:

a second locking member provided movably in the second rear end restriction member and which includes teeth engageable with the teeth of the bottom plate; and a second biasing member which applies a force to the second locking member so as to engage the teeth of the second locking member with the teeth of the bottom plate, the second unlocking portion includes a second operation portion which can manipulate the second locking member in a direction of disengaging the teeth of the second locking member from the teeth of the bottom plate against the biasing force of the second biasing member, and the second operation portion is connected to the first operation portion and manipulated integrally with the first operation portion.

15. The image forming apparatus according to claim 12, wherein the first rear end restriction member provided movably on the cassette main body and the second rear end restriction member provided movably on a bottom plate of the first rear end restriction member, further comprising:

a connection portion which connects the second rear end restriction member to the bottom plate when the second rear end restriction member is retracted upstream of the first wall in the sheet feeding direction; and a connection release portion which releases connection made by the connection portion when the first rear end restriction member is moved to a downstream end of the first rear end restriction member in the sheet feeding direction in a moving range of the first rear end restriction member.

16. The image forming apparatus according to claim 15, wherein the bottom plate includes a through-hole formed to be opposed to the second rear end restriction member when the second rear end restriction member is retracted upstream of the first wall in the sheet feeding direction, the connection portion includes:

a protrusion member provided on the second rear end restriction member, and insertable into the through-hole when the second rear end restriction member is retracted upstream of the first wall in the sheet feeding direction; and a protrusion biasing member which applies a force to the protrusion member in a direction of the through-hole so that the protrusion member protrudes from the through-hole, the connection release portion includes a rib provided in the cassette main body so as to abut on a tip end of the protrusion member and which has an inclined surface formed downstream in the sheet feeding direction to be closer to the second rear end restriction member, the protrusion member protrudes from the through-hole to lock the second rear end restriction member to the first rear end restriction member, and the protrusion member is pressed by the inclined surface against the biasing force of the protrusion biasing member when the first rear end restriction member slides downstream in the sheet feeding direction, and the protrusion member is detached from the through-hole to release the connection of the second rear end restriction member to the bottom plate when the first rear end restriction member slides to the downstream end of the first rear end restriction member in the sheet feeding direction.

* * * * *